United States Patent [19]

Arita et al.

[11] Patent Number: 4,545,762

[45] Date of Patent: Oct. 8, 1985

[54] APPARATUS FOR PRODUCING OXIDIZED FILAMENTS

[75] Inventors: Yosihumi Arita; Yukihiro Murakami; Miyabi Yuasa, all of Ehime, Japan

[73] Assignee: Toray Industries, Inc., Tokyo, Japan

[21] Appl. No.: 545,504

[22] Filed: Oct. 26, 1983

[30] Foreign Application Priority Data

Oct. 28, 1982 [JP] Japan ..... 57-189765

[51] Int. Cl.[4] ..... F27B 9/28

[52] U.S. Cl. ..... 432/59; 432/8; 432/77

[58] Field of Search ..... 432/72.77, 59.8

[56] References Cited

U.S. PATENT DOCUMENTS

| | | | |
|---|---|---|---|
| 2,534,973 | 12/1950 | Ipsen et al. | 432/77 |
| 3,306,594 | 2/1967 | Bauer | 432/8 |
| 3,385,946 | 5/1968 | Hatchard | 432/8 |
| 3,837,790 | 9/1974 | Pierson | 432/59 |
| 4,165,964 | 8/1979 | Yonezawa et al. | 432/59 |
| 4,210,097 | 7/1980 | Byrd et al. | 432/8 |

*Primary Examiner*—Henry C. Yuen

*Attorney, Agent, or Firm*—Birch, Stewart, Kolasch & Birch

[57] ABSTRACT

An apparatus for continuously producing continuous oxidized filaments (1) including a series of lower guide rollers (3*a*, 3*b*, 3*c* . . . ) for guiding filaments provided at the outside of the furnace (2) and a series of gas suction seal chambers (8*a*, 8*b*, 8*c* . . . ) provided at the lower portion in the furnace. The gas suction seal chambers have a series of sub-partition plates (23*a*, 23*b*, 23*c* . . . ) which are arranged along the path of the filaments and are provided with gas passing means. The external air which tends to go into the furnace through the slits (10) formed in the bottom wall (20) of the furnace will be drawn into the gas suction seal chambers and prevented from entering the heated oxidizing atmosphere in the furnace. According to the sealing effect, the temperature variance in the furnace will be reduced and the quality of produced filaments will be improved.

10 Claims, 16 Drawing Figures

APPARATUS FOR PRODUCING OXIDIZED FILAMENTS

BACKGROUND OF THE INVENTION

1. Field of Invention

The present invention relates to an apparatus for producing oxidized filaments which are used for example as fire-proof fibers, as reinforcing fibers in slate or concrete board instead of asbestos fibers or as precursor filaments for producing carbon filaments or graphite filaments.

2. Description of Prior Art

It is well known that precursor filaments such as polyacrylonitrile filaments are oxidized by passing through a hot oxidizing atmosphere such as air having a temperature in the range of from about 200° C. to about 300° C. in a furnace. A furnace having a series of guide rollers for guiding the filaments in the furnace is known. One group of the guide rollers is provided at a lower portion and another group of the guide rollers is provided at an upper portion and the filaments are guided along the guide rollers with an up and down path. And further among such furnaces, it is known that there is a type of furnace that the lower guide rollers are provided at the outside of the bottom wall of the furnace and the upper guide rollers are provided at the outside of the top wall of the furnace and another type of furnace where the lower guide rollers are provided at the outside of the bottom wall of the furnace and the upper guide rollers are provided at the upper portion of the inside of the furnace. For example, the former type of furnace is disclosed by Japanese Patent Publication No. SHO 54-1815 and the latter type of furnace is disclosed by Japanese Patent Publication No. SHO 54-1814. Each furnace of these types has slits for passing the filaments through at the bottom wall and further the former type furnace has slits for passing the filaments through at the top wall. In these apparatus, the temperature of the atmosphere is high, since the funnel effect due to a temperature difference between the external air and the internal gas causes a suction of room air having a low temperature through the slits provided at the bottom wall of the furnace or an outblast of hot gas through the slit provided at the top wall of the furnace.

Such an effect leads to various troubles such as variance in the physical properties of filaments produced, poor working conditions and decreased efficiency due to the leakage of hot gas, on account of the temperature variations within the furnace.

To eliminate these troubles, Japanese Patent Publication No. SHO 54-1815 discloses a sealing method in which seal chambers are provided at the top and bottom in the furnace and the slits provided in the top wall and the bottom wall of the furnace are sealed by providing the upper seal chambers with a gas and by drawing out the gas in the bottom seal chambers. This approach is successful to a certain extent in solving the above problems, but it is not enough to reduce the temperature variations within the furnace and to assure the necessary sealability.

Meanwhile, it is vitally important to ensure a uniform of gas stream velocity for the purpose of maintaining a constant temperature within the furnace. As a matter of fact, however, it is difficult to maintain a constant velocity of gas stream to which individual filaments are exposed within the furnace. For instance, it is common practice in designing the oxidizing furnace used for the oxidation of precursor filaments that for the purpose of circulating a hot gas through the furnace, the hot gas outlet provided at one end of the furnace and the hot gas inlet provided at the other end of the furnace are connected outside of the furnace by a gas circulation duct via a circulating fan and a heater. The stream coming into the furnace through the hot gas inlet, however, tends to be disturbed, particularly by the configuration near the gas inlet which makes uneven the stream velocities to which the filaments are exposed. This also tends to make uneven the temperature of the atmosphere to which individual groups of filaments are exposed in the furnace, resulting in a wide variance in the product qualities, and in extreme cases, resulting in a breakage of filaments, which causes a disruption of the continuous operation.

When the filaments are broken, the remedy will be difficult and when a multi-stage heat treatment is conducted with a plurality of furnaces, the remedy will be extremely difficult.

SUMMARY OF THE INVENTION

A primary object of the present invention is to provide an apparatus for producing oxidized filaments with reduced variances in the gas temperature within the furnace.

Another object of the present invention is to provide an apparatus for producing oxidized filaments in which the velocities of gas stream blown to the individual filaments running parallel to one another in the furnace are made uniform, thereby reducing the temperature variances in the furnace.

Still another object of the present invention is to provide an apparatus for producing oxidized filaments in which, in a multi-stage heat treatment for oxidizing the filaments with a plurality of furnaces, even if a roller becomes entangled with broken filaments, the problem can be swiftly remedied while at the same time enhancing the thermal efficiency.

Among the objects mentioned above, the object of reducing the temperature variances within the furnace can be accomplished by utilizing an apparatus for producing oxidized filaments in which the filaments are guided by upper guide rollers provided at the top and outside of the furnace and with the lower guide rollers being provided at the bottom and outside of the furnace. In this apparatus, there are provided a series of hot gas exhaust chambers at the upper portion in the furnace and a series of gas supply seal chambers between the top wall of the furnace and the gas exhaust chambers. At the lower portion in the furnace, there are provided a series of hot gas entrance chambers and a series of gas suction seal chambers between the bottom wall of the furnace and the hot gas entrance chambers.

Meanwhile, said object of the invention to reduce the temperature variances within the furnace can also be accomplished by an apparatus for producing oxidized filaments in which the filaments are guided by upper guide rollers provided at the top inside of a furnace and lower guide rollers at the bottom outside of the furnace. In the apparatus, there are provided a series of hot gas entrance chambers at the upper portion in the furnace. At the lower portion in the furnace, there are provided a series of hot gas entrance chambers and a series of gas suction seal chambers between the bottom wall of the furnace and the hot gas entrance chambers.

On the other hand, the object of the present invention to make stream velocities uniform within the furnace can be accomplished by an apparatus in which a series of hot gas entrance chambers are provided at the lower portion in the furnace. The hot gas entrance chambers have a first lower partition wall having a gas passing means which blows out the hot gas along the direction of the paths of the filaments arranged parallel to one another. In the hot gas entrance chambers, there are provided a plurality of blades which change the direction of the stream of the hot gas and direct the hot gas toward the first lower partition wall. A wire-netting or a perforated plate may be provided either up-stream or down-stream of the blades, or at both up-stream and down-stream of the blades for the purpose of making the gas flow uniform.

And the object of the present invention to swiftly remedy entanglement of broken filaments can be accomplished by an apparatus including a plurality of furnaces arranged in series along the path of the filaments, in which the furnace located at the rearmost position along the path of filaments has its upper guide rollers provided inside of the furnace and its lower guide rollers provided outside of the furnace, while the furnace located at the foremost position along the path of filaments has both its upper guide rollers and lower guide rollers provided outside of the furnace.

BRIEF DESCRIPTION OF THE DRAWINGS

These and other objects of the present invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
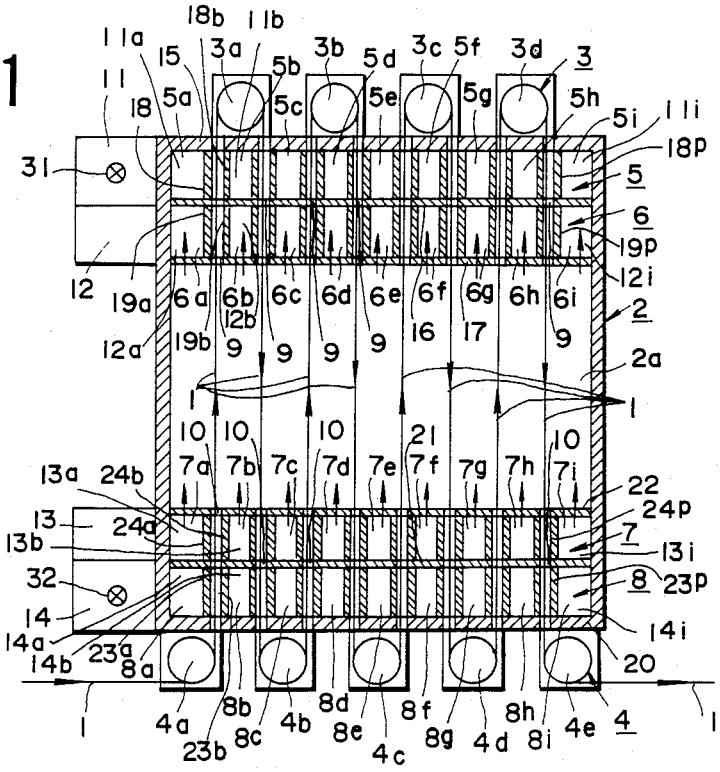
FIG. 1 is a longitudinal sectional view of an apparatus for continuously producing continuous oxidized filaments as the first embodiment of the present invention.

Referring to the drawings, the present invention is to be described in detail.

Figure 2:
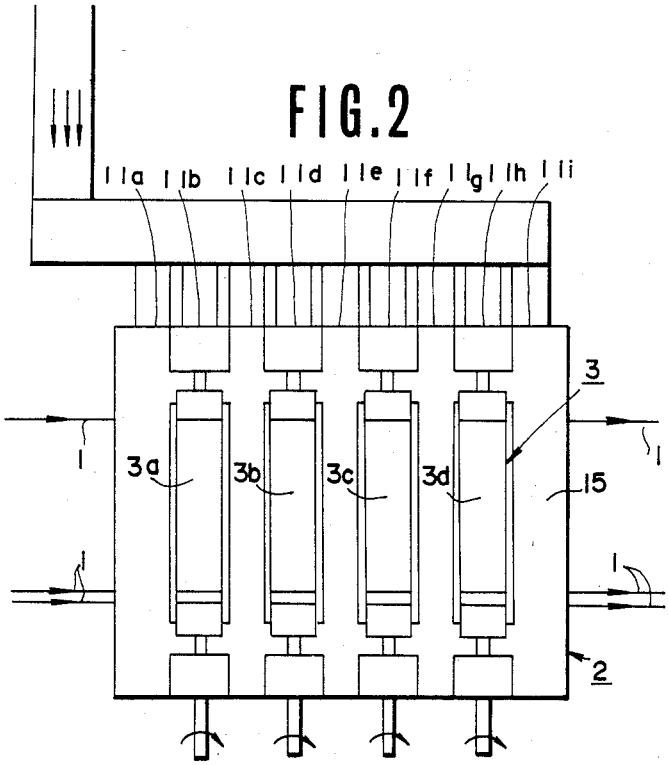
FIG. 2 is a plan view of the apparatus in FIG. 1.

FIGS. 1 to 5, 10 and 11 illustrate an apparatus for continuously producing continuous oxidized filaments as the first embodiment of the present invention. FIG. 1 shows the main parts of the furnace. FIG. 2 shows the furnace as viewed from above.

In these figures a plurality of filaments 1 running parallel are guided by a series of upper guide rollers 3*a*, 3*b*, 3*c* . . . and a series of lower guide rollers 4*a*, 4*b*, 4*c* . . . which are respectively installed at an outside of the top wall 15 and at an outside of the bottom wall 20 of the furnace 2. The furnace 2 has a main chamber 2*a* filled with a heated oxidized atmosphere therein, into which continuous precursor filaments 1 are continuously introduced, and in which the filaments 1 are converted into oxidized filaments 1 as they are passed through the atmosphere and from which oxidized filaments are drawn out of the chamber.

Figure 4:
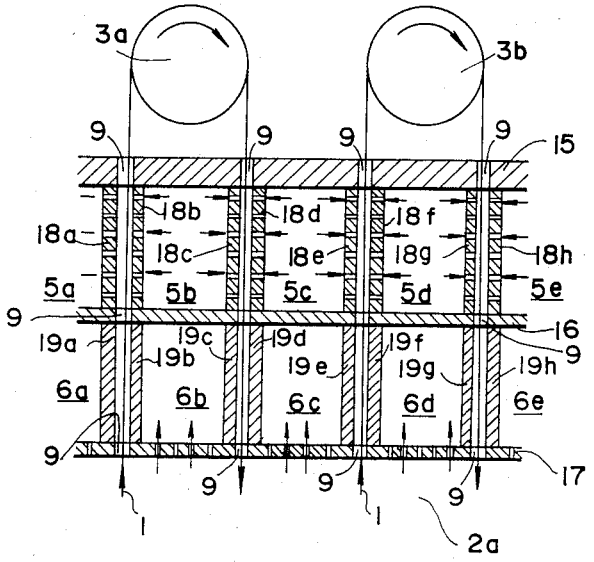
FIG. 4 is a partial sectional view of the area around the gas supply seal chambers in the apparatus of FIG. 1.

At an upper portion in the furnace, as shown in FIG. 4, there are provided a series of gas supply seal chambers 5*a*, 5*b*, 5*c* . . . and below them, a series of hot gas exhaust chambers 6*a*, 6*b*, 6*c* . . . To be more specific, the hot gas exhaust chambers 6*a*, 6*b*, 6*c* . . . are formed between a first upper partition wall 17 and a second upper partition wall 16, and the gas supply seal chambers 5*a*, 5*b*, 5*c* . . . are formed between the top wall 15 of the furnace 2 and the second upper partition wall 16. The first upper partition wall 17 has gas passing means comprising a plurality of holes and is constituted of, for example, a perforated plate or a wire-netting. The hot gas passes through the first upper partition wall 17 from the main chamber 2*a* into the hot gas exhaust chambers 6*a*, 6*b*, 6*c* . . .

There are provided openings 9 in each of the top wall 15 of the furnace 2, the first upper partition wall 17 and the second upper partition wall 16. The hot gas exhaust chambers 6*a*, 6*b*, 6*c* . . . and the gas supply seal chambers 5*a*, 5*b*, 5*c* . . . are partitioned respectively by means of first upper sub-partition plates 19*a*, 19*b*, 19*c* . . . and second upper sub-partition plates 18*a*, 18*b*, 18*c* . . . The filaments 1 guided by the upper guide rollers 3*a*, 3*b*, 3*c* . . . and the lower guide rollers 4*a*, 4*b*, 4*c* . . . pass the openings 9, the path formed between the two adjacent first upper sub-partition plates 19*a*, 19*b*, 19*c* . . . and the path formed between the two adjacent second upper sub-partition plates 18*a*, 18*b*, 18*c* . . .

As indicated in FIG. 1, there are provided a series of gas inlets 11*a*, 11*b*, 11*c* . . . at the positions corresponding to the gas supply seal chambers 5*a*, 5*b*, 5*c* . . . on the side wall of the furnace 2. The second upper sub-partition plates 18*a*, 18*b*, 18*c* . . . which are provided along the path of filaments 1 are constructed of perforated plates or wire-nettings so as to permit the passage of the gas therethrough. The gas (external air) supplied to the gas supply seal chambers 5*a*, 5*b*, 5*c* will pass through the second upper sub-partition plates 18*a*, 18*b*, 18*c* . . . and seal the openings 9 and the path between the two adjacent second upper sub-partition plates 18*a*, 18*b*, 18*c* . . .

There are provided a series of hot gas outlets 12*a*, 12*b*, 12*c* . . . at the positions corresponding to the hot gas exhaust chambers 6*a*, 6*b*, 6*c* . . . on the side wall of the furnace 2. The hot gas in the main chamber 2*a* passes through the first upper partition wall 17 into the hot gas exhaust chambers 6*a*, 6*b*, 6*c* . . . and is exhausted through the hot gas outlets 12*a*, 12*b*, 12*c* . . . to the hot gas outlet duct 12.

Therefore, in the apparatus shown in FIG. 4, for example, the gas supply seal chamber 5*b* is formed in a gas supply seal box which is constructed of the second upper partition wall 16, the second upper sub-partition plate 18*b* having the gas passing means, the top wall 15 of the furnace 2, the second upper sub-partition plate 18*c* having the gas passing means, one of the side walls of the furnace 2 and the other side wall of the furnace 2 having the gas inlet 11*b*, and for example, the gas exhaust chamber 6*b* is formed in a gas exhaust box which is constructed of the first upper partition wall 17 having the gas passing means, the first upper sub-partition plate 19*b*, the second upper partition wall 16, the first upper sub-partition plate 19*c*, one of the side walls of the furnace 2 and the other side wall of the furnace 2 having the gas outlet 12*b*.

Figure 4A:
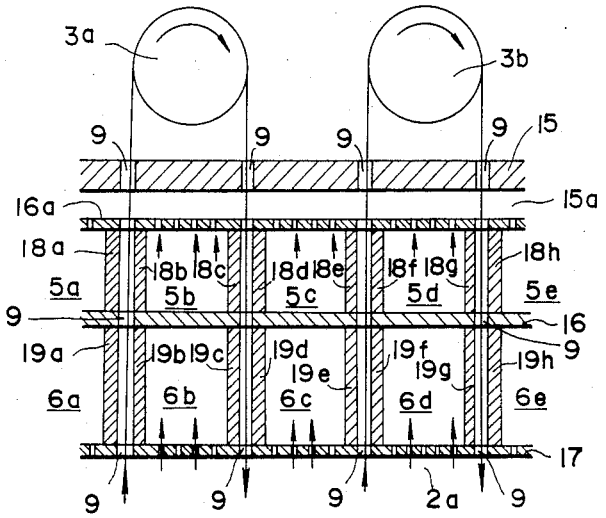
FIG. 4A is a partial sectional view of another preferred embodiment of the area around the gas supply seal chambers in the apparatus of FIG. 1.

In FIG. 4A, another preferred structure of the area around the gas supply seal chambers 5*a*, 5*b*, 5*c* . . . is shown. In the apparatus shown in FIG. 4A, a third upper partition wall 16*a* is provided at the top surfaces of the gas supply seal chambers 5*a*, 5*b*, 5*c* . . . The third upper partition wall 16*a* has gas passing means and is constituted of a means such as a perforated plate or a wire-netting. In the apparatus shown in FIG. 4A, the second upper sub-partition plates 18*a*, 18*b*, 18*c* . . . do not have the gas passing means shown in FIG. 4, and a room 15*a* is provided between the third upper partition wall 16*a* and the top wall 15 of the furnace 2. In the apparatus shown in FIG. 4A, for example, the gas supply seal chamber 5*b* is formed in a gas supply seal box which is constructed of the second upper partition wall 16, the second upper sub-partition plate 18*b*, the third upper partition wall 16*a* having the gas passing means, the second upper sub-partition plate 18*c*, one of the side walls of the furnace 2 and the other side wall of the furnace 2 having the gas inlet 11*b*, and for example, the gas exhaust chamber 6*b* is formed in a gas exhaust box which is constructed of the first upper partition wall 17 having the gas passing means, the first upper sub-partition plate 19*b*, the second upper partition wall 16, the first upper sub-partition plate 19*c*, one of the side walls of the furnace 2 and the other side wall of the furnace 2 having the gas outlet 12*b*.

Figure 5:
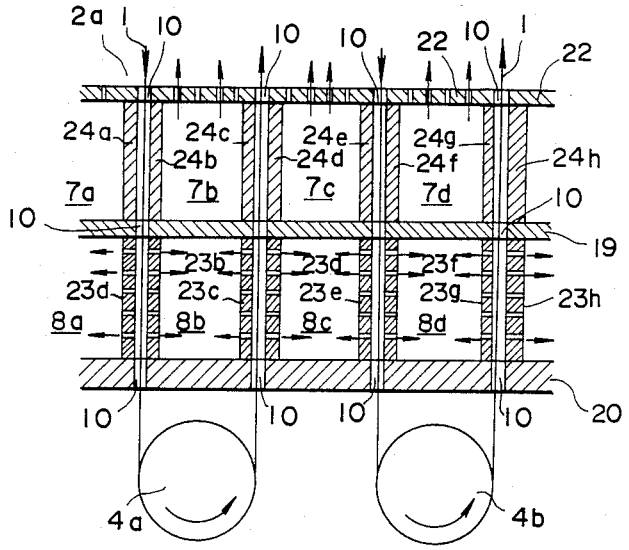
FIG. 5 is a partial sectional view of the area around the gas suction seal chambers in the apparatus of FIG. 1.

At the lower portion in the furnace 2, as shown in FIG. 5, there are provided a series of lower seal chambers 8*a*, 8*b*, 8*c* . . . and, above them, a series of hot gas entrance chambers 7*a*, 7*b*, 7*c* . . . To be more specific, the hot gas entrance chambers 7*a*, 7*b*, 7*c* . . . are formed between a first lower partition wall 22 and a second lower partition wall 21, and the gas suction seal chambers 8*a*, 8*b*, 8*c* . . . are formed between the bottom wall 20 of the furnace 2 and the second lower partition wall 21. The first lower partition wall 22 has gas passing means such as holes and consists of a means such as a perforated plate or a wire-netting. The hot gas passes through the first lower partition wall 22 from the hot gas entrance chambers 7*a*, 7*b*, 7*c* . . . into the main chamber 2*a*.

There are provided openings 10 in each of the bottom wall 20 of the furnace 2, the first lower partition wall 22 and the second lower partition wall 19. The hot gas entrance chambers 7*a*, 7*b*, 7*c* . . . and the gas suction seal chambers 8*a*, 8*b*, 8*c* . . . are partitioned respectively by means of first lower sub-partition plates 24*a*, 24*b*, 24*c* . . .

As indicated in FIG. 1, there are provided a series of gas outlets 14*a*, 14*b*, 14*c* . . . at the positions corresponding to the gas suction seal chambers 8*a*, 8*b*, 8*c* . . . on the side wall of the furnace 2.

The second lower sub-partition plates 23*a*, 23*b*, 23*c* . . . which are provided along the path of filaments 1 are constructed of perforated plates or wire-nettings so as to pass the gas therethrough. Therefore, the external air and the hot gas will be sucked into the gas suction seal chambers 8*a*, 8*b*, 8*c* . . . through the second lower sub-partition plates 23*a*, 23*b*, 23*c* . . . and exhausted through the gas outlets 14*a*, 14*b*, 14*c* . . . so that the external air will be prevented from entering the main chamber 2*a* through openings 10.

On the side wall of the furnace, there are provided a series of hot gas inlets 13*a*, 13*b*, 13*c* . . . at the positions corresponding to the hot gas entrance chambers 7*a*, 7*b*, 7*c* . . . The hot gas is introduced into the hot gas entrance chambers 7*a*, 7*b*, 7*c* . . . through the hot gas inlets 13*a*, 13*b*, 13*c* . . . from the hot gas inlet duct 13.

Figure 3:
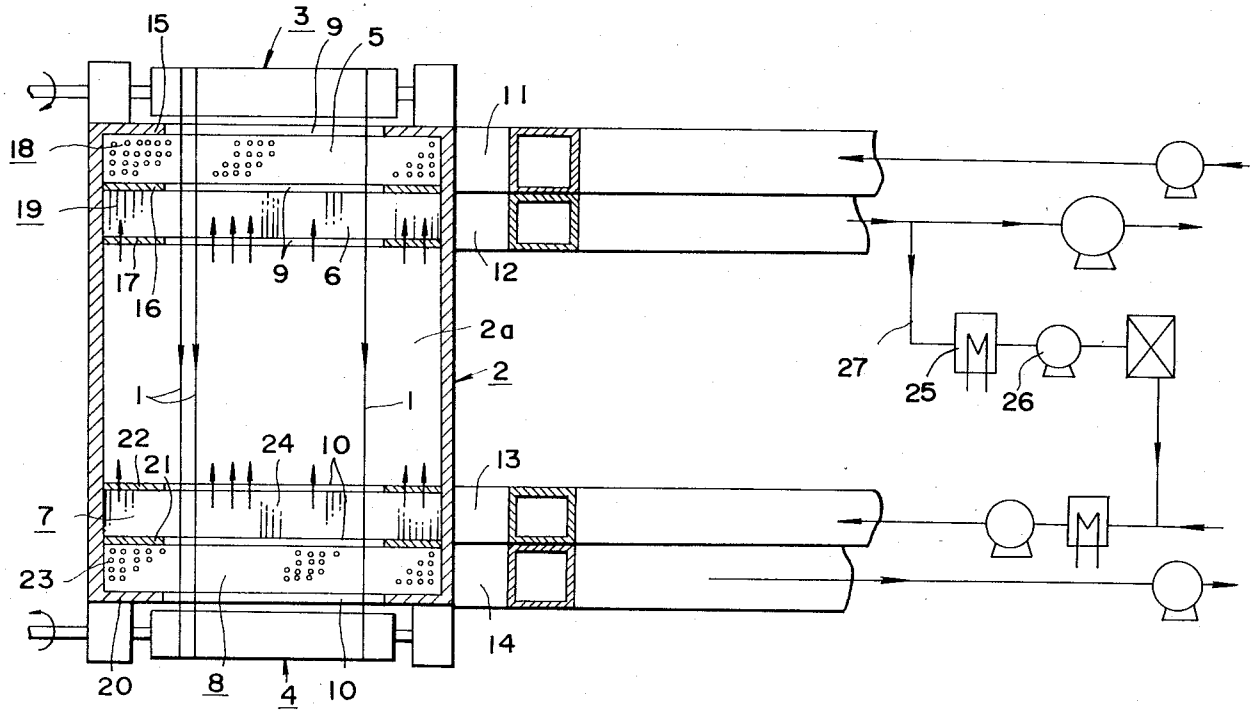
FIG. 3 is a cross sectional view of the same apparatus in FIG. 1 as cut at a right angle.

As illustrated in FIG. 3, the hot gas outlet 12 and the hot gas inlet 13 may be communicated through a gas circulation duct 27 via a heater 25 and a fan 26.

In the apparatus shown in FIG. 5, for example, the gas suction seal chamber 8*b* is formed in gas suction seal box which is constructed of the second lower partition wall 19, the second lower sub-partition plate 23*b* having the gas passing means, the bottom wall 20 of the furnace 2, the second lower sub-partition plate 23*c* having the gas passing means, one of the side walls of the furnace 2 and the other side wall of the furnace 2 having the gas outlet 14*b*, and for example, the gas entrance chamber 7*b* is formed in a gas entrance box which is constructed of the first lower partition wall 22 having the gas passing means, the first lower sub-partition plate 24*b*, the second lower partition wall 19, the first lower sub-partition plate 24*c*, one of the side walls of the furnace 2 and the other side wall of the furnace 2 having the gas inlet 13*b*.

Figure 5A:
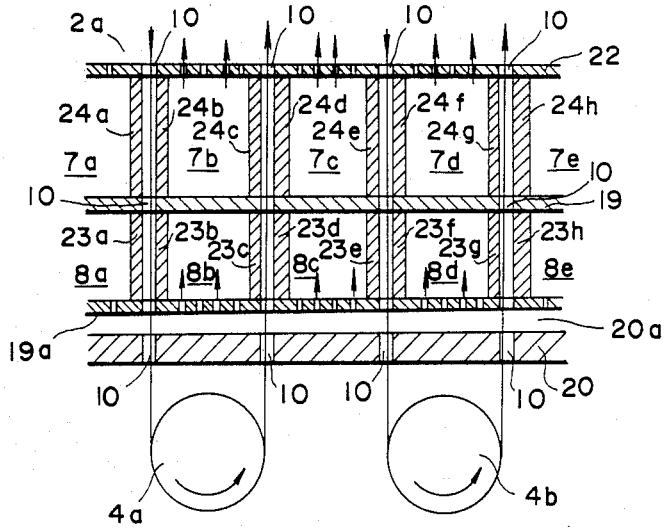
FIG. 5A is a partial sectional view of another preferred embodiment of the area around the gas suction seal chambers in the apparatus of FIG. 1.
Figure 6:
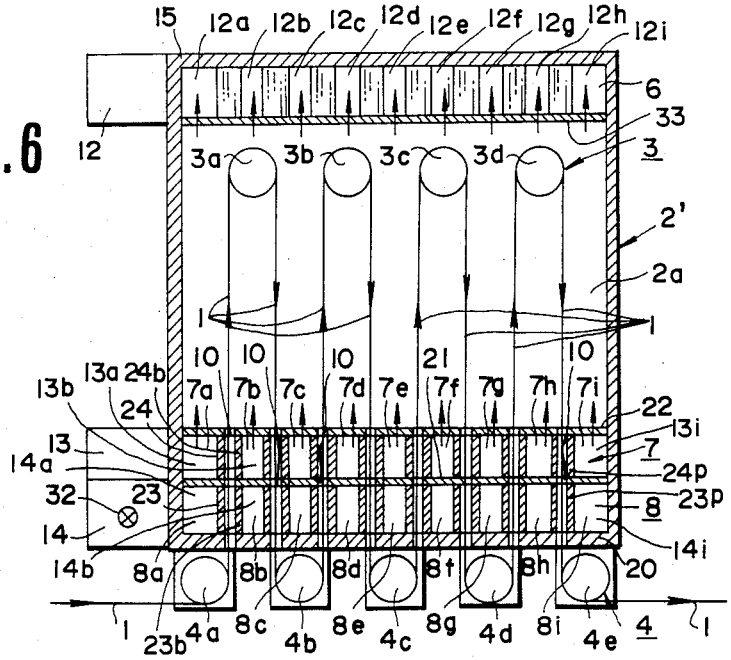
FIG. 6 is a longitudinal sectional view of an apparatus for producing oxidized filaments as the second embodiment of the present invention.
Figure 7:
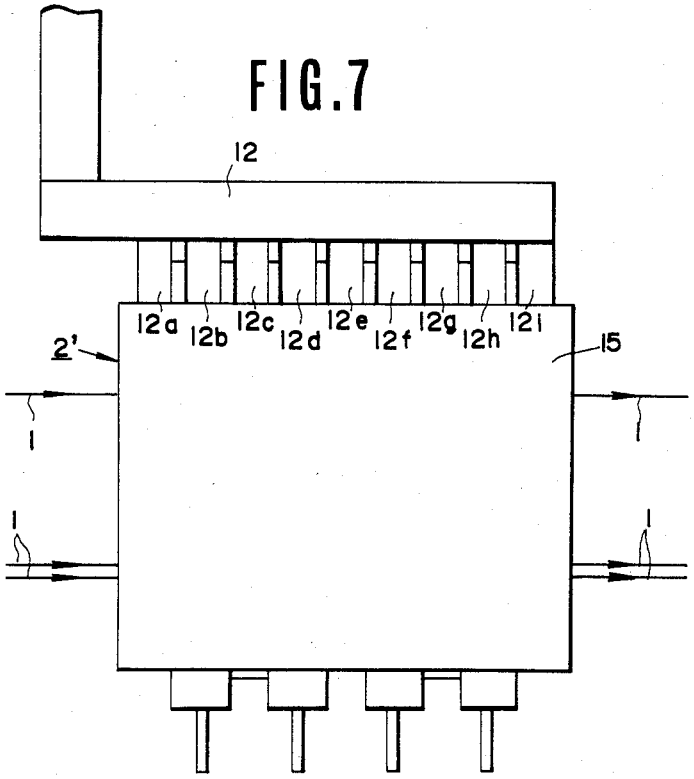
FIG. 7 is a plan view of the apparatus in FIG. 6.
Figure 8:
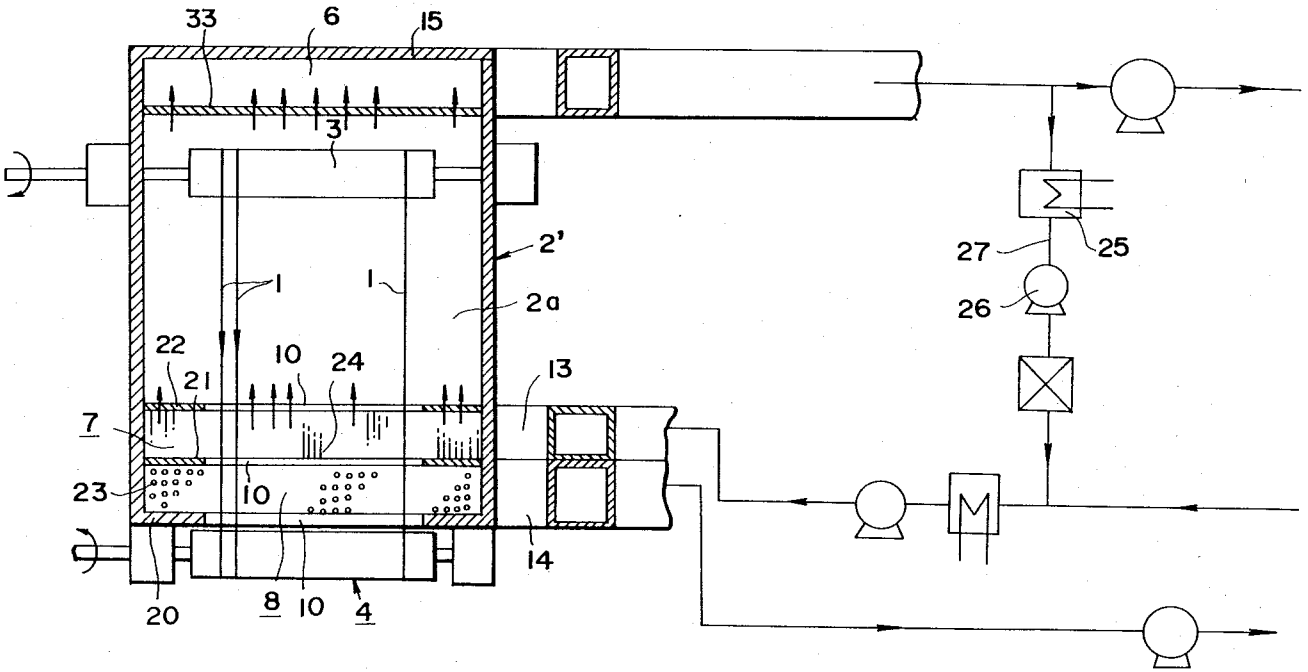
FIG. 8 is a cross sectional view of the same apparatus in FIG. 6 as cut at a right angle.
Figure 9:
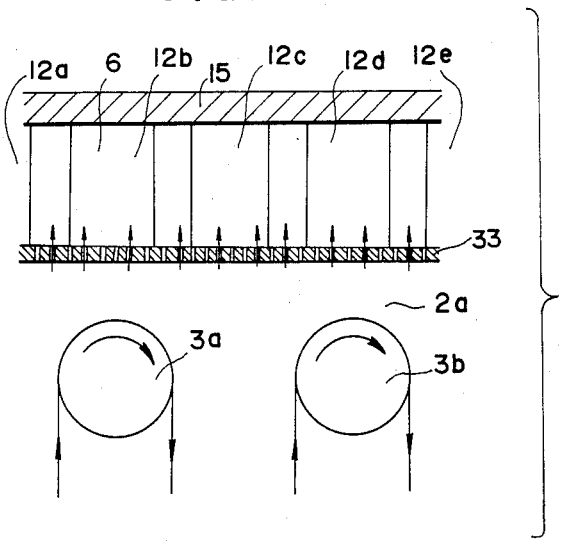
FIG. 9 is a partial sectional view of the area around the hot gas exhaust chambers in the apparatus of FIG. 6.

In FIG. 5A, another preferred structure of the area around the gas suction seal chambers 8*a*, 8*b*, 8*c* . . . is shown. In the apparatus shown in FIG. 5A, a third lower partition wall 19*a* is provided at the bottom surfaces of the gas suction seal chambers 8*a*, 8*b*, 8*c* . . . The third lower partition wall 19*a* has a gas passing means and constitutes of a means such as a perforated plate or a wire-netting. In the apparatus shown in FIG. 5A, the second lower sub-partition plates 23*a*, 23*b*, 23*c* . . . do not have the gas passing means shown in FIG. 5, and a room 20*a* is provided between the third lower partition wall 19*a* and the bottom wall 20 of the furnace 2. In the apparatus shown in FIG. 5A, for example, the gas suction seal chamber 8*b* is formed in a gas suction seal box which is constructed of the second lower partition wall 19, the second lower sub-partition plate 23*b*, the third lower partition wall 19*a* having the gas passing means, the second lower sub-partition plate 23*c*, one of the side walls of the furnace 2 and the other side wall of the furnace 2 having the gas outlet 14*b*, and for example, the gas entrance chamber 7*b* is formed in a gas entrance box which is constructed of the first lower partition wall 22 having the gas passing means, the first lower sub-partition plate 24*b*, the second lower partition wall 19, the first lower sub-partition plate 24c, one of the side walls of the furnace 2 and the other side wall of the furnace 2 having the gas inlet 13b.

Figure 10:
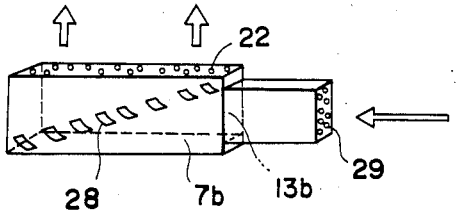
FIG. 10 is a partial oblique view of the area around the gas entrance chambers in the apparatus of FIG. 1 and FIG. 6.
Figure 11:
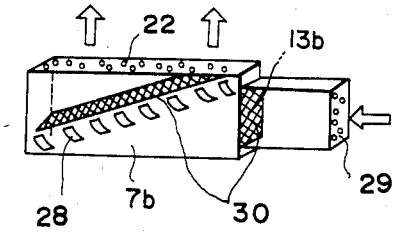
FIG. 11 is a partial oblique view of the area around the gas entrance chambers in the apparatus of FIG. 1 and FIG. 6 different from those in FIG. 11.

In FIG. 10, there is shown one of the hot gas entrance chambers 7a, 7b, 7c . . . In each of the hot gas entrance chambers 7a, 7b, 7c . . ., there are provided a plurality of blades 28 which change the direction of the stream of the hot gas flowing into the gas entrance chambers 7a, 7b, 7c . . . and direct the hot gas toward the first lower partition wall 22. At the up-stream of the blades 28, there is provided a means 29 for making gas flow uniform which is constructed of a perforated plate or a wire-netting. A plurality of means 30 for making gas flow uniform may be provided at both up-stream and down-stream of the blades 28 as shown in FIG. 11.

In FIG. 10, the blades 28 are arranged so that the uppermost one comes closest to the hot gas inlet 13b and the lowermost one is farthest removed from the hot gas inlet 13b. Due to the blade arrangement the hot gas can have its direction changed to the whole width of the group of the running filaments. However, this blade arrangement may be reversed, that is, the blades may be arranged so that the lowermost one comes closest to the hot gas inlet and the lowermost one is farthest removed from the hot gas inlet. It is desirable that the blades 28 be nearly as wide as the hot gas entrance chamber 7b.

Usually, the blades 28 are shaped in an arc of $\frac{1}{4}$ circle and they are arranged with approximately equal spacing, but their shape and spacing are non-restrictive.

In case that the first lower partition wall 22 or the means 29 is constructed of the perforated plate, the holes are desirably distributed evenly in the perforated plate, the diameter of the holes being desirably 3–8 mm. The ratio A/B of the sum (A) of the areas of the holes of the perforated plate to the total area (B) of the perforated plate is desirably in the range of 0.3–0.5. The gas passing means which are provided at the first lower partition plate 22, the first upper partition plate 17, the second lower sub-partition plates 23a, 23b, 23c . . . , the second upper sub-partition plates 18a, 18b, 18c . . . , the third upper partition wall 16a or the third lower partition wall 19a also have desirably said diameter and said ratio A/B of 0.3–0.5.

In the first embodiment of the invention, at the bottom of the furnace the hot gas from gas entrance chambers 7a, 7b, 7c . . . is introduced into the main chamber 2a in a direction from bottom toward top.

Therefore, the external air tends to be sucked into the main chamber 2a through the lower openings 10, but hindered by the gas suction seal chambers 8a, 8b, 8c . . . , the external air can hardly be sucked into the main chamber 2a. According to the sealing effect, the temperature variance is small even at the bottom of the main chamber 2a.

At the top of the furnace 1, the hot gas flows from the main chamber 2a into the hot gas exhaust chambers 6a, 6b, 6c . . . and partially tends to escape out of the furnace 2 through the upper openings 9. However, gas supplied from the gas supply chambers 5a, 5b, 5c . . . seals the upper openings 9 and prevents the hot gas from escaping out of the furnace 2 due to the funnal effect.

In this invention, if the pressure at the gas inlets 11a, 11b, 11c . . . connected to the gas supply seal chambers 5a, 5b, 5c . . . is set slightly higher than the pressure at the hot gas outlets 12a, 12b, 12c . . . connected to the hot gas exhaust chambers 6a, 6b, 6c . . . and the pressure at the hot gas inlets 13a, 13b, 13c . . . connected to the hot gas entrance chambers 7a, 7b, 7c . . . is set slightly higher than the pressure at the gas outlets 14a, 14b, 14c . . . connected to the gas suction seal chambers 8a, 8b, 8c . . . , the infiltration of the external air will be reduced and the temperature distribution will be equalized. In this instance, the pressure difference is desirably set at 2–20 mm Aq.

It is possible to detect the pressure of the gas flow and adjust the exhaust or entrance volume of the gas when a pressure gauge 31 is installed at the gas inlet duct 11 connected to the gas supply seal chambers 5a, 5b, 5c . . . or similarly a pressure gauge 32 is installed at the gas outlet duct 14 connected to the gas suction seal chambers 8a, 8b, 8c . . .

It is also conceivable to set a temperature gauge or a pressure gauge within the furnace so that, when the temperature or the pressure within the furnace reached a dangerous level, the danger can be detected and then the supply of the gas to the gas supply seal chambers 5a, 5b, 5c . . . or the exhaust of the gas from the gas suction seal chamber 8a, 8b, 8c . . . can be halted to lower the sealing effect and release the hot gas out of the furnace, thereby averting a possible runaway of the furnace.

The first embodiment of the present invention will produce the following advantages over the prior art.

The temperature variances within the furnace can be minimized so that the physical properties of individual filaments can be stabilized and in consequence high-quality carbon filaments can be obtained.

With the sealability enhanced, there is little possibility of the gas in the furnace escaping into the environment so that the working environment can be prevented from deteriorating.

With the sealability enhanced, the hot gas leakage is minimized so that the efficiency can be improved. For instance, when the gas is heated by electric power, the power consumption can be substantially reduced.

Utilizing the funnel effect, it can be designed so that in the event of an emergency the furnace can be forcibly cooled.

As for the effect of the blades 28, it should be noted that uniforming of the stream velocity in the main chamber 2a can be extremely improved by the blades 28 and the perforated plates or the wire-nettings 22, 29. For instance, when the mean stream velocity was 2 m/sec in the main chamber 2a, the velocity variance could be easily adjusted to the range of 1.5–2.5 m/sec. As a result of the velocity variance having been so much reduced, the temperature variance in the main chamber 2a dropped correspondingly and the quality variance of the oxidized filaments 2 could be substantially eliminated.

If the blades 28 is designed free to change in the direction, the adjusting ability of the blades will be extremely enhanced. When the stream velocity in the main chamber 2a is required to be freely variable for the purpose of securing high quality filament products, the requirement will be easily satisfied by such blades.

FIGS. 5 to 9 illustrate the second embodiment of the present invention. The bottom structure of the apparatus in the second embodiment of the invention is the same as that of the apparatus in the first embodiment shown precisely in FIG. 5 or FIG. 5A, but the top structure of the apparatus in the second embodiment differs from that in the first embodiment. In FIGS. 5 to 9, the members equivalent to the ones in the first embodiment bear the same reference numerals in the first embodiment. Only what is different from the first embodiment will be explained below.

The top of the furnace 2' is tightly sealed by the top wall 15 and the upper guide rollers 3a, 3b, 3c . . . are provided inside of the furnace 2'. At the inside of the furnace 2' asnd above the upper guide rollers 3a, 3b, 3c . . . , there is provided a hot gas exhaust chamber 6. To be more specific, the upper partition wall 33 is located at a position below the top wall 15 of the furnace 2' and above the upper guide rollers 3a, 3b, 3c . . . Between the top wall 15 of the furnace 2' and the upper partition wall 33, there is formed the hot gas exhaust chamber 6 which is consisted of a single chamber. The hot gas exhaust chamber 6 is equipped with a series of hot gas outlets 12a, 12b, 12c . . . which are provided at the side wall of the furnace 2'. The upper partition wall 33 constituting the lower wall of the hot gas exhaust chamber 6 has gas passing means comprising a plurality of holes and is constructed of a means such as a perforated plate and a wire-netting.

The hot gas outlet 12a, 12b, 12c . . . may be communicated with the hot gas inlets 13a, 13b, 13c . . . connected to the hot gas entrance chambers 7a, 7b, 7c . . . through a gas circulation duct 27 via a heater 25 and a fan 26.

In the apparatus of the second embodiment of the invention, the upper guide rollers 3a, 3b, 3c . . . are located inside of the furnace 2' and the upper openings in the top wall 15 of the furnace 2' are non-existent. Therefore, there is no escape of the hot gas through the openings and accordingly the thermal efficiency and the working environment are improved. Besides, with no need to provide a series of upper seal chambers, the net length of heating the filaments can be increased, resulting in a high efficiency of oxidization. Furthermore, since the filaments do not go out of the top of the furnace and they are not cooled with the guide rollers 3a, 3b, 3c . . . located outside of the furnace top, the number of cool-heat-cool cycles that filaments are subjected to is small and in consequence the filaments are less liable to break.

Figure 12:
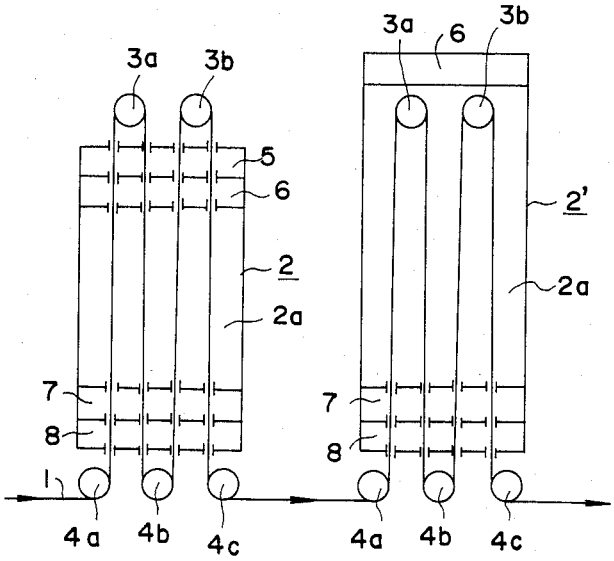
FIG. 12 shows a schematic layout in an apparatus consisting of two furnaces as the third embodiment of the present invention.
Figure 13:
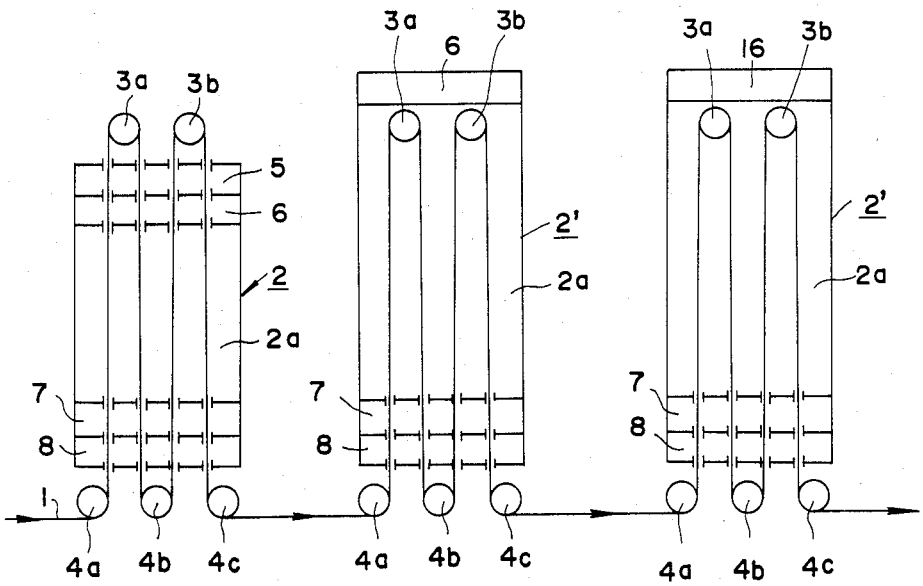
FIG. 13 shows a schematic layout in an apparatus consisting of three furnaces.
Figure 14:
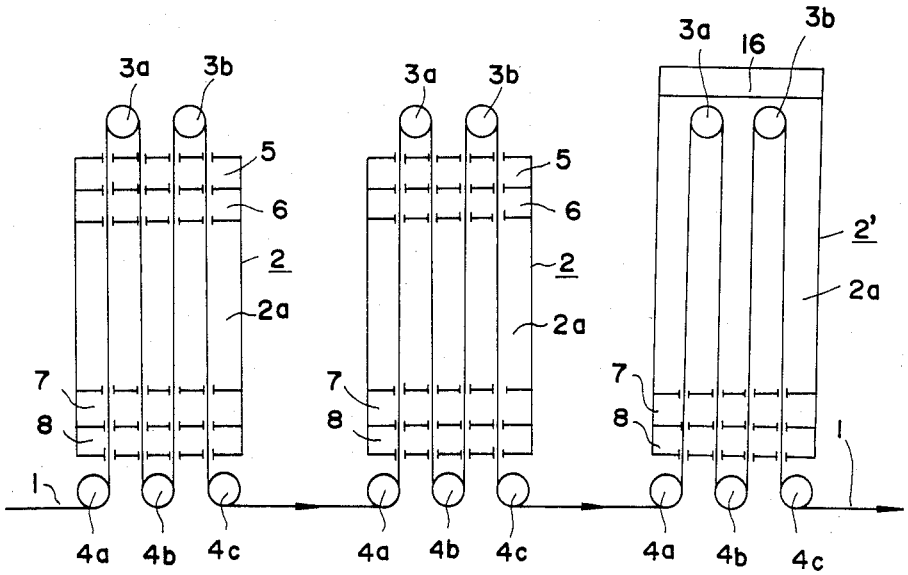
FIG. 14 shows a different arrangement of the furnaces from the arrangement in FIG. 13, of an apparatus consisting of three furnaces.

FIGS. 12 to 14 illustrate an apparatus for continuously producing continuous oxidized filaments according to the third embodiment of the invention. In this embodiment, the apparatus comprises at least one first apparatus including a furnace 2 with the upper guide rollers 3a, 3b, 3c . . . located outside and at least one second apparatus including a furnace 2' with the upper guide rollers 3a, 3b, 3c . . . located inside. The furnace 2 has the same construction as the one in the first embodiment of the invention and the furnace 2' has the same construction as the one in the second embodiment of the invention. These first apparatuses and second apparatuses are arranged in series along the path of the filaments, but the apparatus located at the foremost position along the path of filaments 1 consists of said first apparatus and the apparatus located at the rearmost position along the path of filaments consists of said second apparatus.

FIG. 12 illustrates an apparatus consisting of one first apparatus including the furnace 2 and one second apparatus including the furnace 2'.

FIG. 13 illustrates an apparatus consisting of one first apparatus including the furnace 2 and two second apparatuses each including the furnace 2'.

FIG. 14 illustrates another apparatus consisting of two first apparatus each including the furnace 2 and one second apparatus including the furnace 2'.

In the above furnaces in which the filaments are oxidized, it is common practice to step up the heating temperature from the foremost furnace toward the rearmost furnace.

In the case of using the furnace of the same size, the rearer a furnace is located, that is, the higher the temperature of the atmosphere in a furnace is, the contribution of the furnace to oxidization of filaments will become the greater. According to the experiments performed by the inventors of the present invention, in the case of an apparatus consisting of three furnaces arranged in series, the filament breakage occurs 65% in the foremost furnace, 30% in the middle furnace and 5% in the rearmost furnace. Thus, it is seen that more breakages occur in the foremost furnace and the occurrence of breakage is substantially reduced in the rearmost furnace.

For this reason, in the present invention the foremost apparatus whose contributions to filaments oxidization are minor is designed with both the upper and lower guide rollers located at the outside of the furnace 2 so as to facilitate disposal of broken filaments, while the rearmost apparatus, which is less liable to cause the filament breakage trouble and whose contribution to filament oxidization is significant, is designed with the upper guide rollers located at the inside and the lower guide rollers located at the outside of the furnace 2', so that the apparatus of the present invention, being free from filament breakage trouble and having power consumption cut to about half, is improved in the efficiency of production by 12% in comparison with the conventional apparatus with all the furnaces having outside guide rollers.

According to the apparatus shown in FIG. 14 in which the foremost and middle apparatuses have the upper guide rollers located at the outside of the furnace 2 and the rearmost apparatus has the upper guide rollers located at the inside of the furnace 2', with the roller-to-roller distances in all the furnaces set constant at 9 m, the following contribution to filament oxidation is obtained.

| | Treating temperature (°C.) | Contribution to oxidization (C) | Net heating length (D) | Contribution in combined terms of (C) and (D) |
|---|---|---|---|---|
| No. 1 furnace | 220 | 1.0 | 3.0 m/pass | 1.0 (about 6%) |
| No. 2 furnace | 240 | 3.0 | " | 3.0 (about 17%) |
| No. 3 furnace | 260 | 2.0 | " | 13.5 (about 77%) |

In the above table, if the rearmost furnace has outside upper guide rollers, the contribution of the rearmost furnace in combined terms of C and D will be reduced from 13.5 to 3.09.

Thus, the third embodiment of the present invention can provide an apparatus for producing carbon filaments characterized by quick disposal of roller entanglement with broken filaments, an increased thermal efficiency, saving of power consumption, increased contribution to filament oxidization and accordingly an increased productivity.

What is claimed is:

1. An apparatus for continuously producing continuous oxidized filaments comprising a furnace containing a heated oxidized atmosphere therein, said furnace being provided with an upper wall and a bottom wall, means for continuously introducing precursor filaments into the furnace where they are converted into oxidized filaments and means for removing the oxidized filaments from the furnace, a plurality of upper guide rollers provided in the upper portion of the furnace and a plurality of lower guide rollers provided outside the furnace adjacent the bottom wall thereof, said filaments being conveyed on said guide rollers, a plurality of hot gas entrance chambers provided at the lower portion of the furnace, said entrance chambers communicating with the furnace, at least one hot gas exhaust chamber provided in the upper portion of the furnace between the plurality of upper guide rollers and the top wall of the furnace, said exhaust chamber communicating with the furnace, a plurality of gas suction seal chambers disposed in the furnace between the plurality of hot gas entrance chambers and the bottom wall of the furnace, a plurality of apertures provided in the bottom wall for passing the filaments guided by the lower guide rollers and the upper guide rollers therethrough, a plurality of filament paths formed between adjacent gas suction seal chambers and adjacent hot gas entrance chambers, respectively, a main hot gas chamber formed between the plurality of hot gas entrance chambers and the hot gas exhaust chamber, hot gas passing means provided in the top wall of each of the hot gas entrance chambers and in the bottom wall of each of the hot gas exhaust chambers whereby said entrance and exhaust chambers are in fluid communication with the main hot gas chamber, a seal gas passing means provided at a wall of each of the gas suction seal chambers, being in fluid communication with the filament paths;

a hot gas supply means in fluid communication with each of the hot gas entrance chambers, a hot gas exhaust means in fluid communication with the hot gas exhaust chamber, and a seal gas suction means in fluid communication with each of the gas suction seal chambers.

2. The apparatus of claim 1 wherein:

(a) a bottom room is provided between each of the gas suction seal chambers and the bottom wall of the furnace; and (b) the seal gas passing means is provided at the bottom wall of each of the gas suction seal chambers, said bottom wall.

3. The apparatus of claim 1 wherein:

(a) the bottom surface of each of the gas suction seal chambers is closed; and (b) the seal gas passing means is provided at both side surfaces of each of the gas suction seal chambers.

4. The apparatus of claim 1 wherein a hot gas circulating means is provided between the hot gas exhaust means and the hot gas supply means to be operable to return the hot gas from the hot gas exhaust chambers to the hot gas entrance chambers.

5. The apparatus of claim 1 wherein the hot gas passing means and the seal gas passing means are holes provided in perforated plates, respectively.

6. The apparatus of claim 1 wherein the hot gas passing means and the seal gas passing means are openings provided in wire-nettings, respectively.

7. The apparatus of claim 1 wherein there are provided, in each of the gas entrance chambers, a plurality of blades which change the direction of the stream of the hot gas flowing into the gas entrance chambers and direct the stream toward the hot gas passing means provided at the top wall of each of the gas entrance chambers.

8. The apparatus of claim 7 wherein a means for making a uniform gas flow is provided either up-stream or down-stream of the blades.

9. The apparatus of claim 7 wherein means for making the gas flow uniform are provided both up-stream and down-stream of the blades.

10. The apparatus of claim 1 wherein the ratio A/B of the sum A of the areas of the hot gas passing means provided at the top wall of each of the hot gas entrance chambers to the total area B of the top wall of each of the hot gas entrance chambers is in the range of 0.3–0.5.

* * * * *